US012747550B2

(12) United States Patent
Park

(10) Patent No.: US 12,747,550 B2
(45) Date of Patent: Sep. 29, 2026

(54) STRUCTURAL PERFORMANCE-IMPROVED SAFETY APPARATUS FOR PREVENTING FALLING AND SUICIDE BY JUMPING

(71) Applicant: SYSTEM KOREA CO., LTD., Gwangmyeong-si (KR)

(72) Inventor: Sea Man Park, Gwangmyeong-si (KR)

(73) Assignees: SYSTEM KOREA CO., LTD., Gwangmyeong-si (KR); SYSTEM K&J CO., LTD., Gimpo-si (KR)

( * ) Notice: Subject to any disclaimer, the term of this patent is extended or adjusted under 35 U.S.C. 154(b) by 70 days.

(21) Appl. No.: 18/859,549

(22) PCT Filed: Apr. 24, 2023

(86) PCT No.: PCT/KR2023/005541

§ 371 (c)(1),
(2) Date: Oct. 24, 2024

(87) PCT Pub. No.: WO2023/211087

PCT Pub. Date: Nov. 2, 2023

(65) Prior Publication Data

US 2025/0290260 A1 Sep. 18, 2025

(30) Foreign Application Priority Data

Apr. 25, 2022 (KR) ..... 10-2022-0050674

(51) Int. Cl.
*E01D 19/10* (2006.01)
*E04H 17/00* (2006.01)

(52) U.S. Cl.
CPC ..... *E01D 19/103* (2013.01); *E04H 17/003* (2013.01)

(58) Field of Classification Search
CPC ..... E01D 19/10; E01D 19/103; E04F 11/18; E04F 11/1836; E04F 11/1861;
(Continued)

(56) References Cited

U.S. PATENT DOCUMENTS 6,585,233 B1 * 7/2003 Sorben ..... E04H 17/004 256/12
11,028,614 B1 * 6/2021 Robinson ..... E04H 17/004
(Continued)

FOREIGN PATENT DOCUMENTS

JP 2007-2651 A 1/2007
JP 2007002651 A * 1/2007 ..... E04F 11/18
(Continued)

*Primary Examiner* — Josh Skroupa
(74) *Attorney, Agent, or Firm* — Han's Law Office

(57) ABSTRACT

A structural performance-improved safety apparatus for preventing falling and suicide by jumping, which is coupled to an existing or newly-installed railing. The safety apparatus comprising support main bodies coupled to railing posts of an existing or newly-installed railing, branch parts spaced from each other in the vertical direction on the support main bodies and extending in the front direction, and rotary rails rotatably coupled to the front end parts of the branch parts by means of rotating shafts. The cross-section of the support main bodies is gradually reduced toward the upper sides thereof and, at the same time, is provided with ribs. Bearings are installed, and outside rainwater is prevented from entering inside the bearings. The rotary rails may be installed even when, as in the case of a curved bridge, the installation direction of the rotary rails gradually changes.

6 Claims, 16 Drawing Sheets

(58) Field of Classification Search
CPC ..... E04F 2011/1868; E04F 2011/1876; E04H 17/003
USPC ..... 256/11, 12, 16
See application file for complete search history.

(56) References Cited

U.S. PATENT DOCUMENTS

| | | | | | |
|---|---|---|---|---|---|
| 12,134,910 | B1 * | 11/2024 | Gould | ..... | E04H 17/004 |
| 2019/0032290 | A1 * | 1/2019 | Park | ..... | E04H 17/004 |

FOREIGN PATENT DOCUMENTS

| | | | | | | |
|---|---|---|---|---|---|---|
| JP | 2010-248771 | A | | 11/2010 | | |
| KR | 20050112687 | A | * | 12/2005 | ..... | E04F 11/18 |
| KR | 101054443 | B1 | * | 8/2011 | ..... | E04F 11/18 |
| KR | 20160103853 | A | * | 9/2016 | ..... | E01D 19/103 |
| KR | 20170000373 | U | * | 1/2017 | ..... | G08B 21/02 |
| KR | 10-2019-0053533 | A | | 5/2019 | | |
| KR | 10-2021-0059452 | A | | 5/2021 | | |
| KR | 10-2434746 | B1 | | 8/2022 | | |

* cited by examiner

[FIG. 1A]
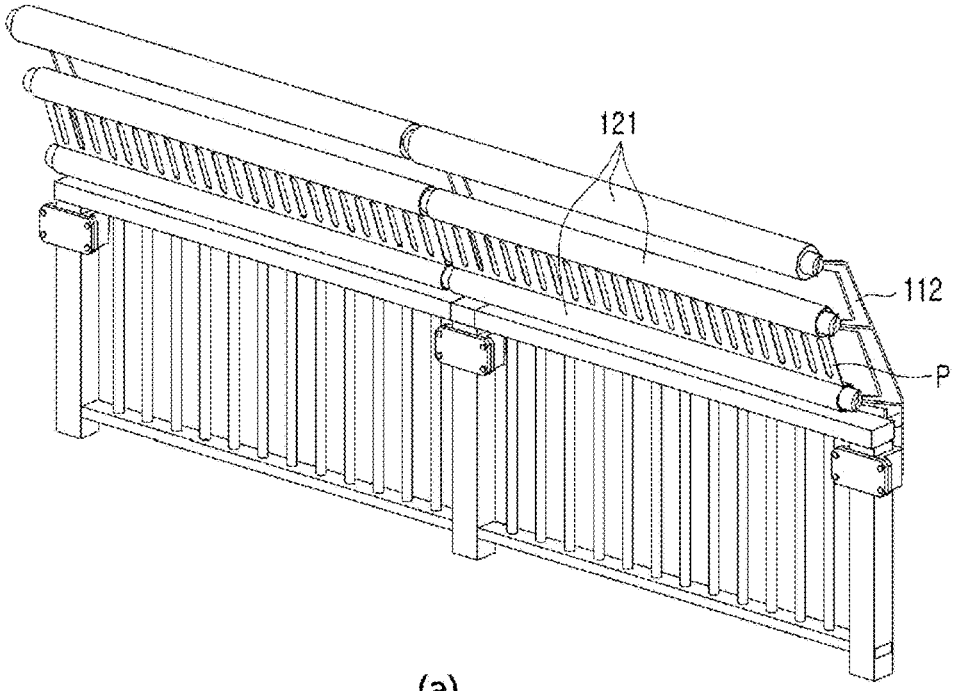
(a)
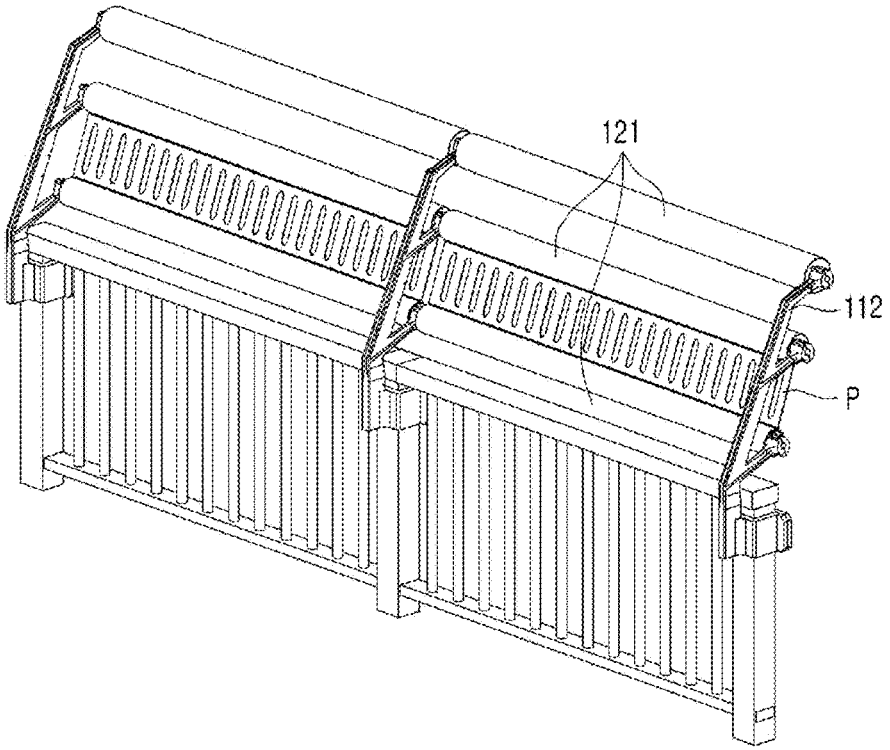
(b)

[FIG. 1B]
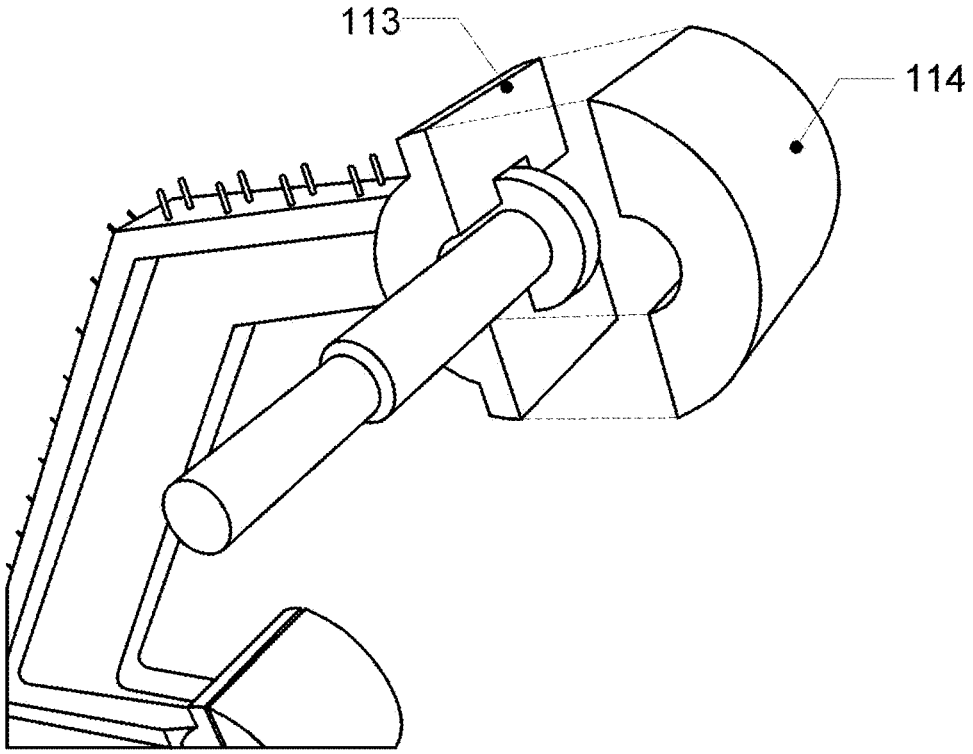

[FIG. 2]
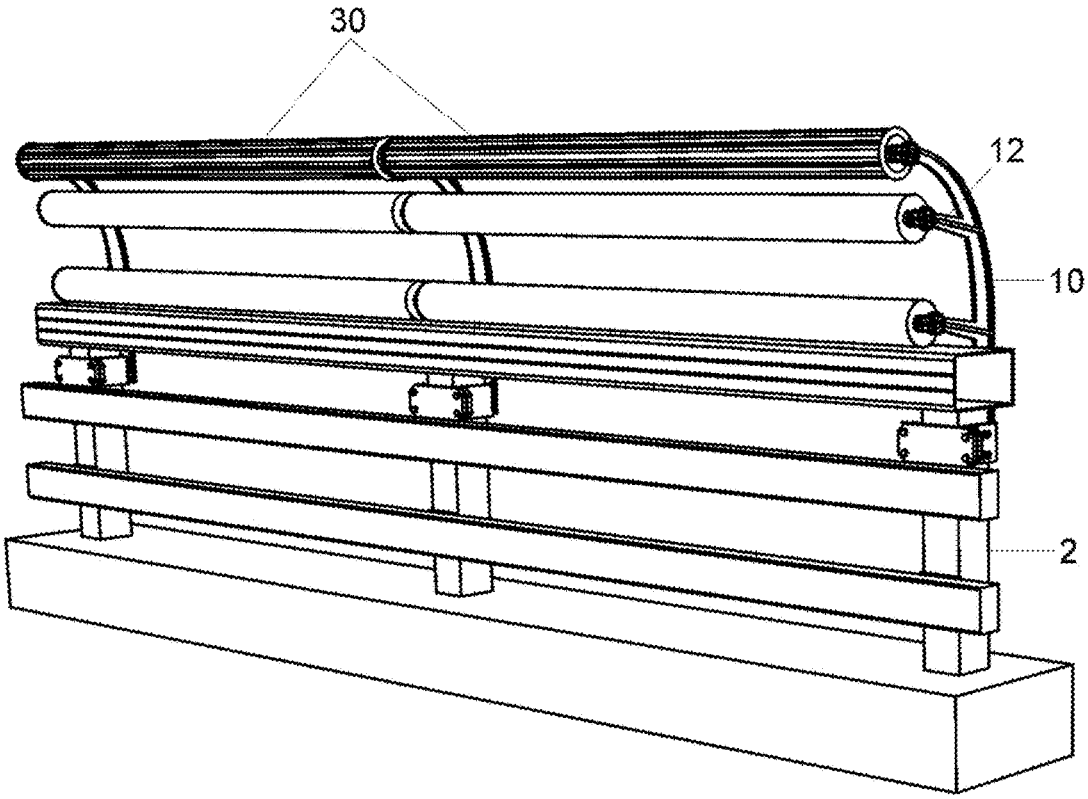
[FIG. 3]
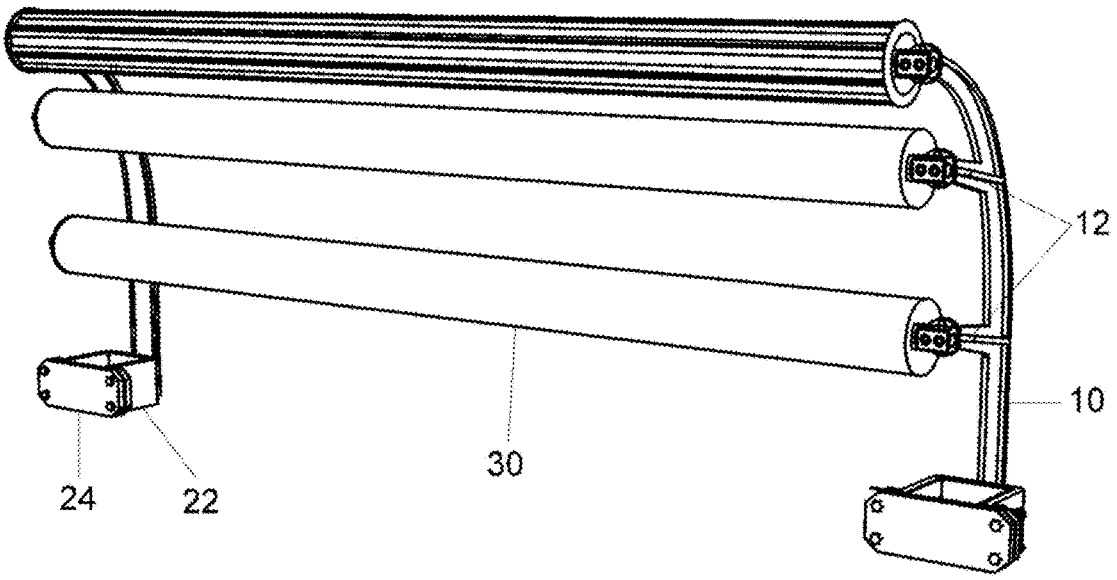

[FIG. 4]
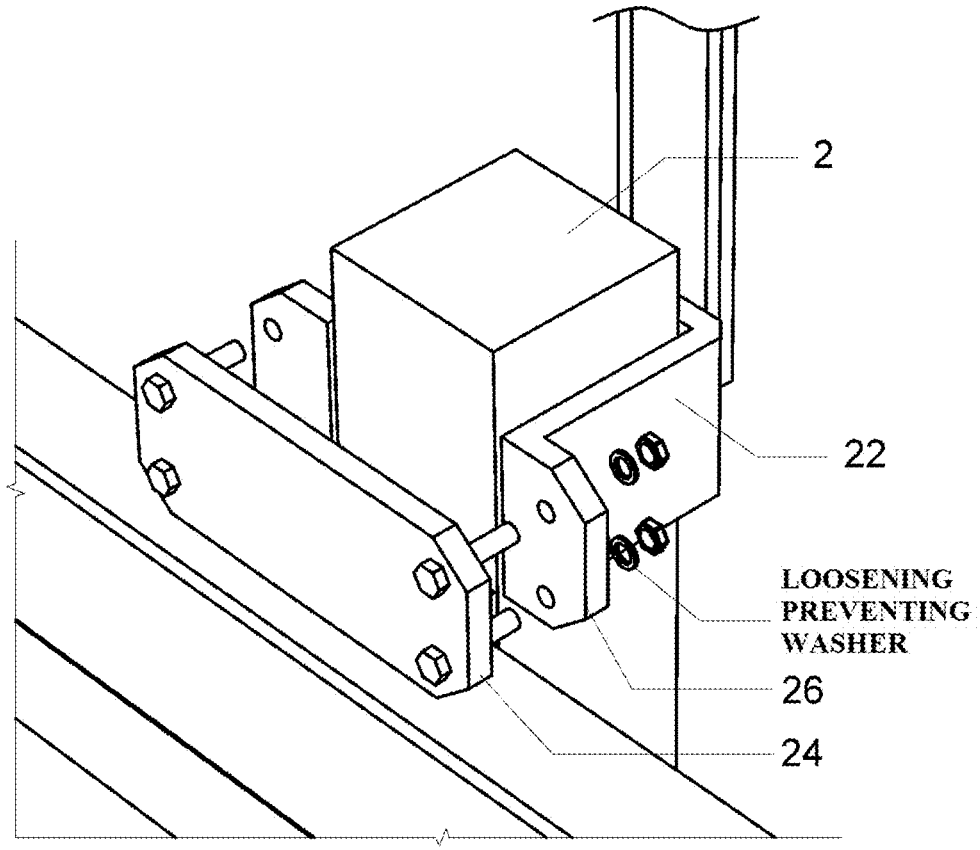

[FIG. 5]
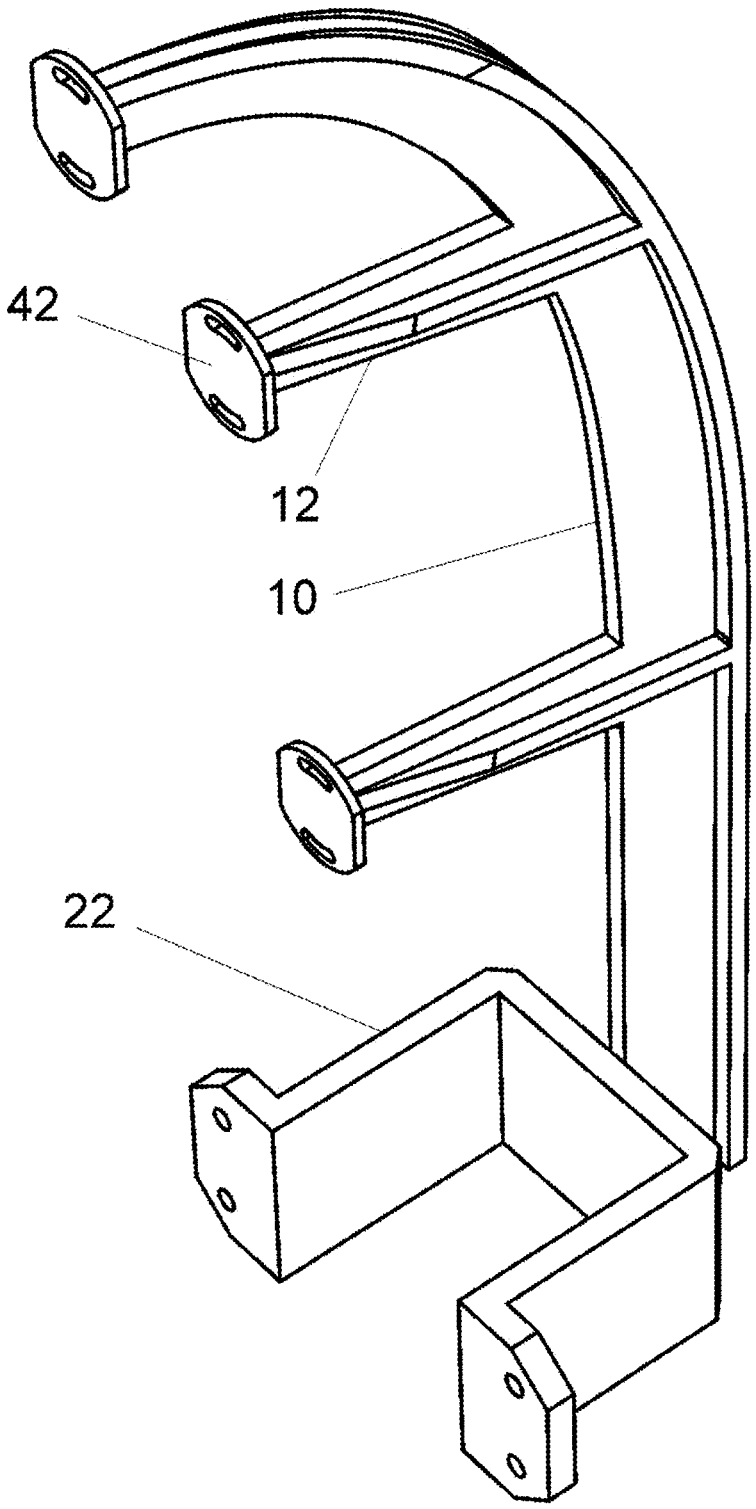

[FIG. 6]
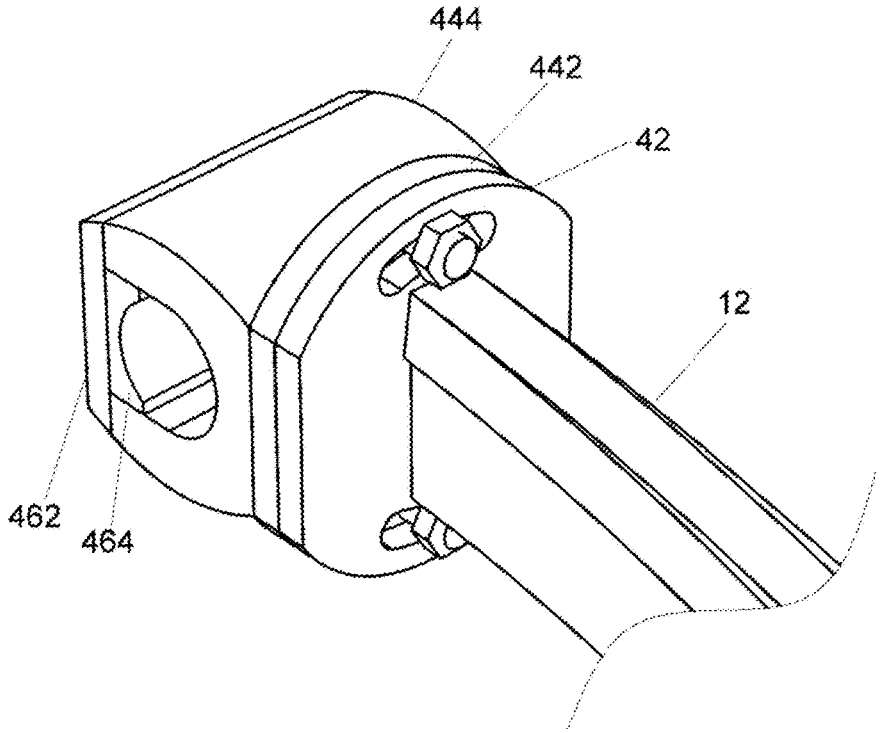
[FIG. 7]
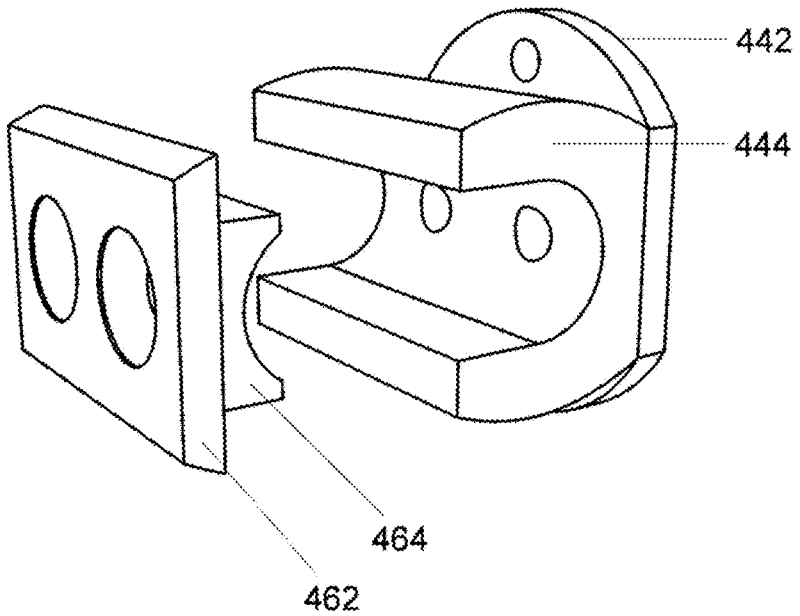

[FIG. 8]
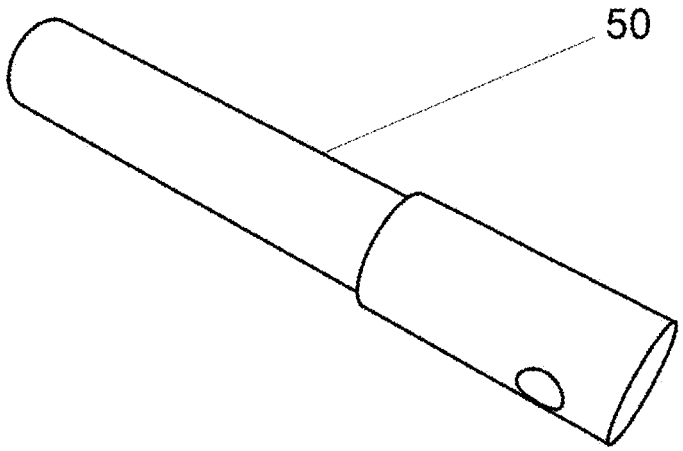
[FIG. 9]
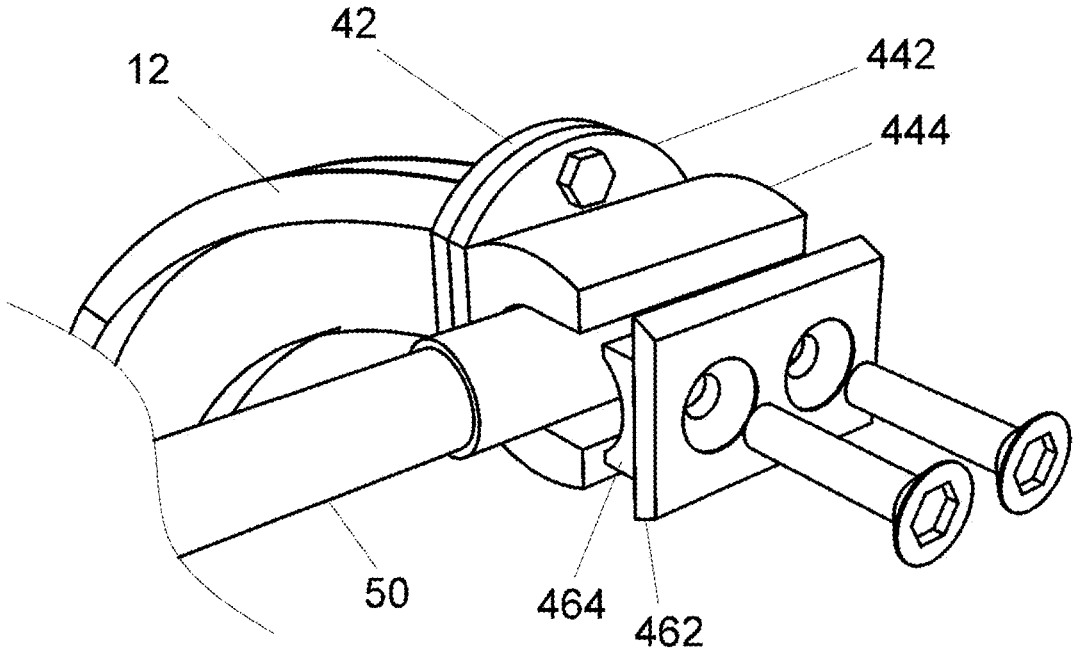

[FIG. 10]
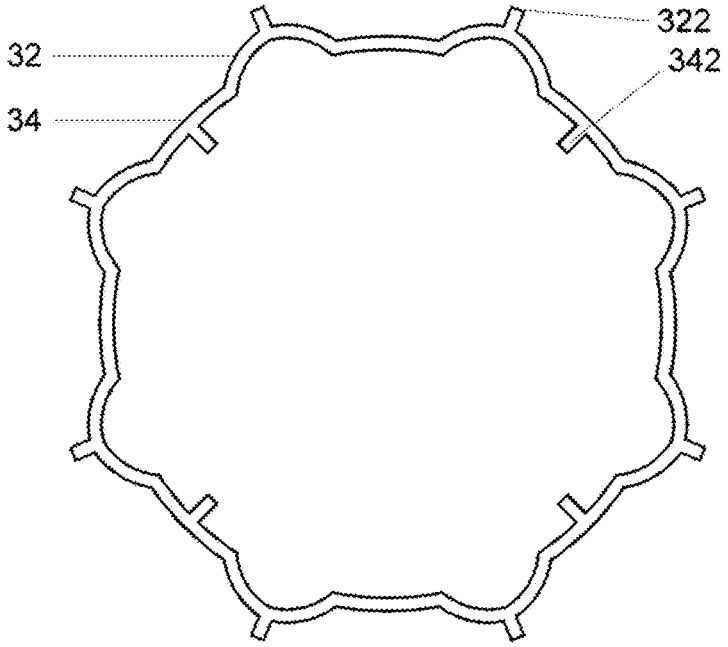
[FIG. 11]
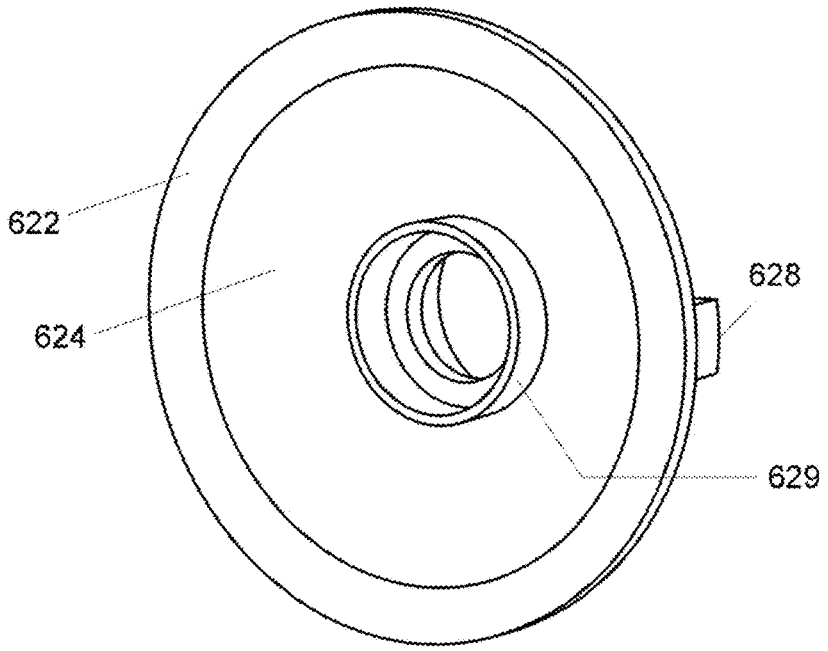

[FIG. 12]
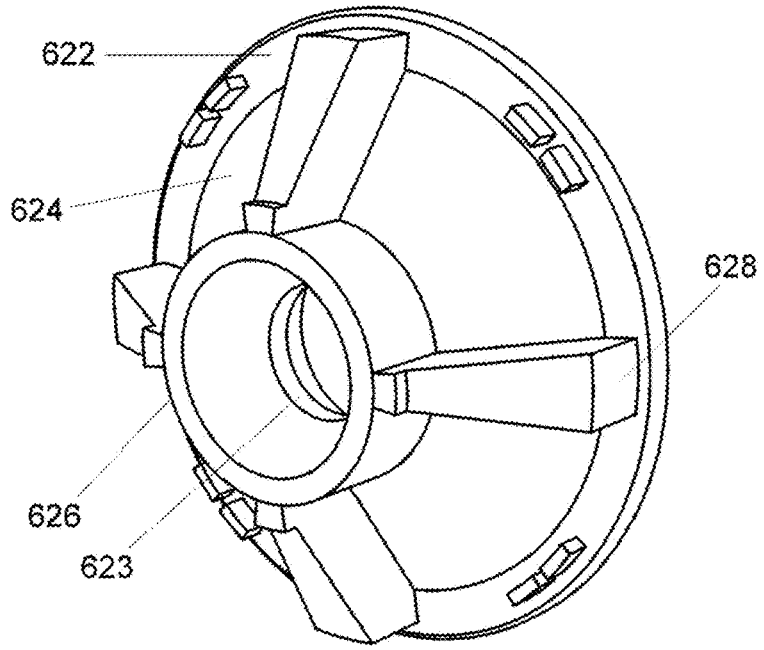
[FIG. 13]
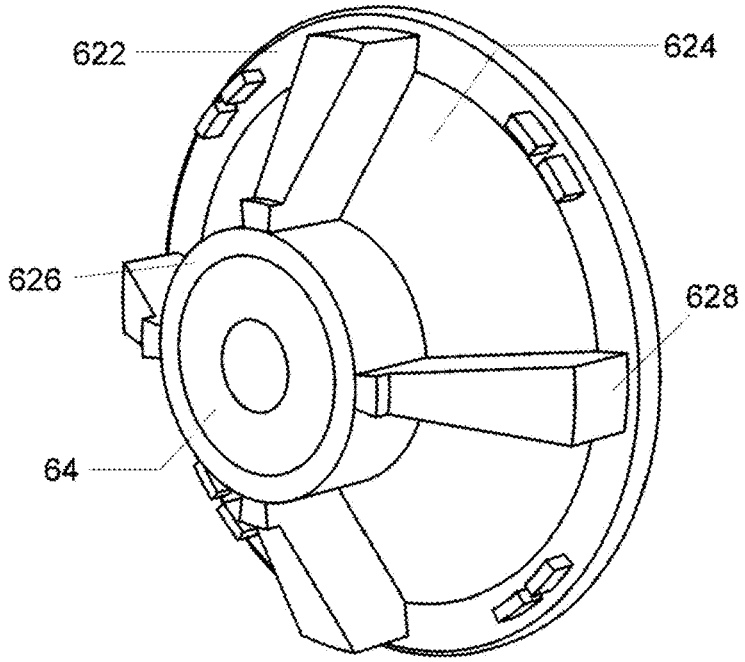

[FIG. 14]
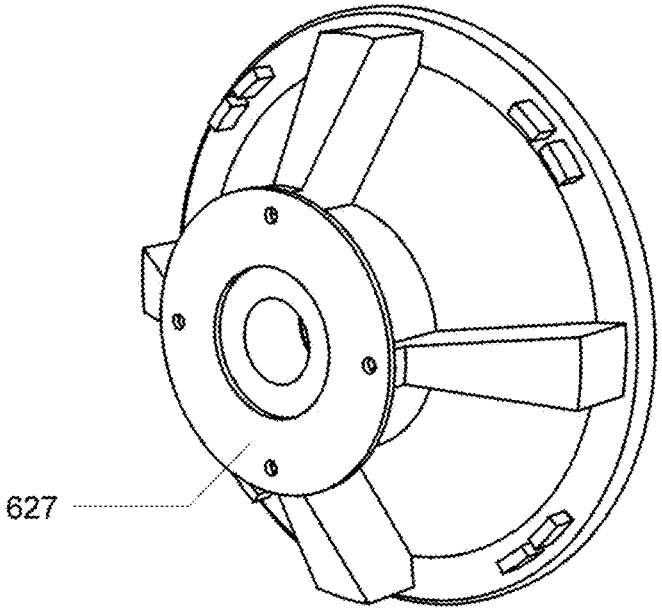
[FIG. 15]
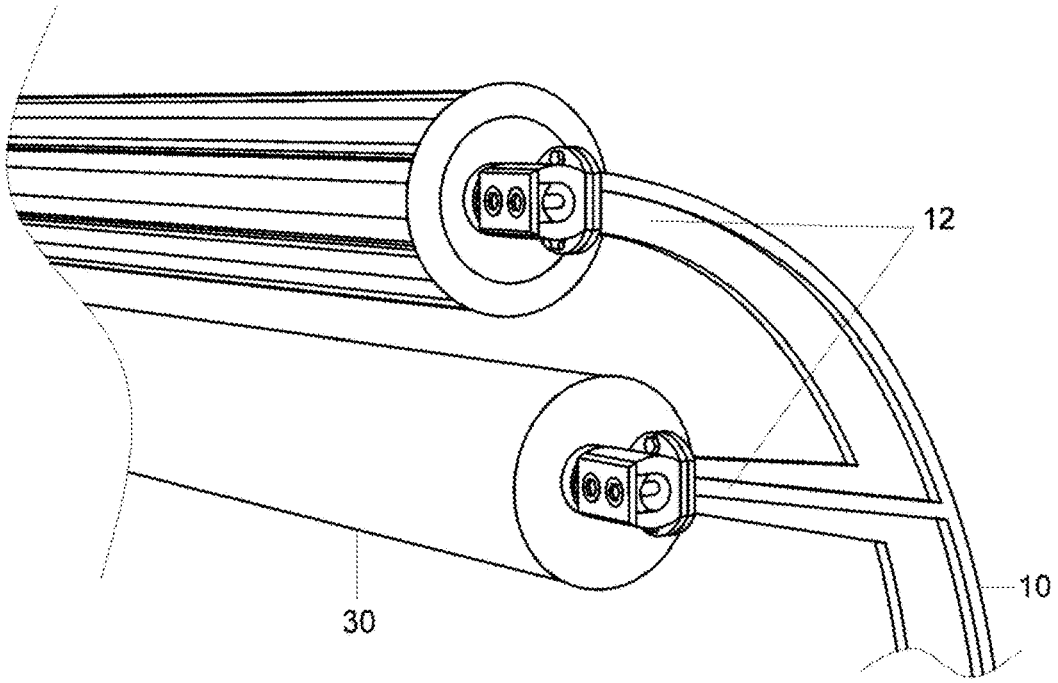

[FIG. 16A]
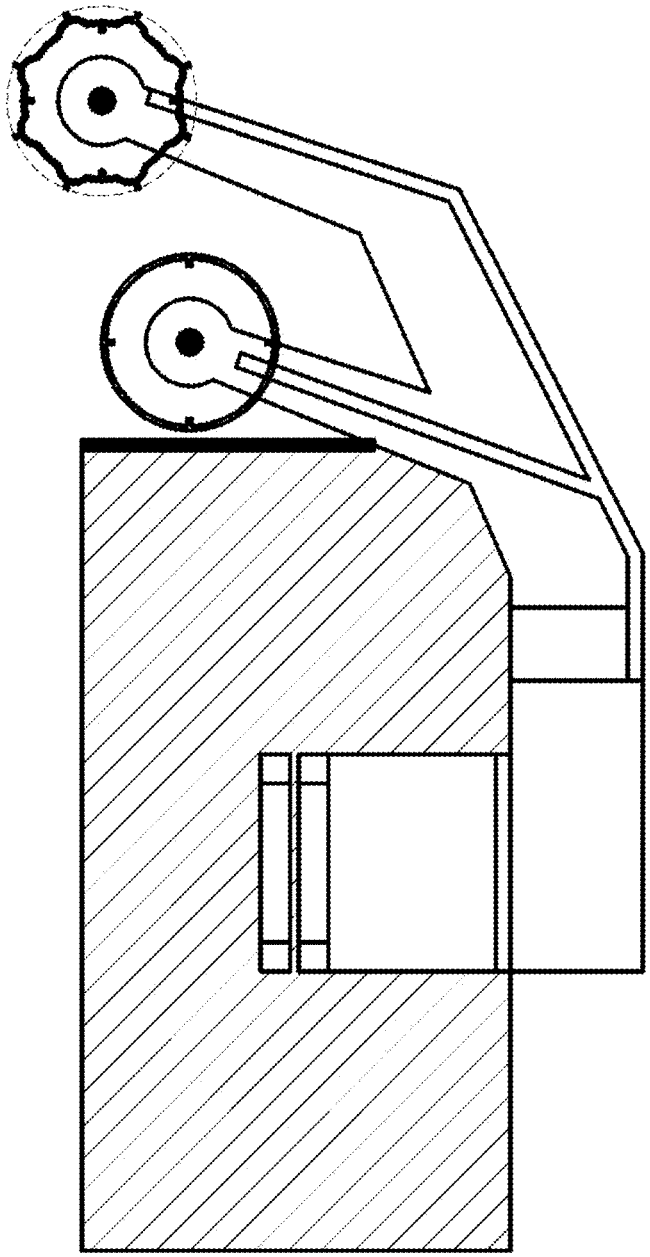

[FIG. 16B]
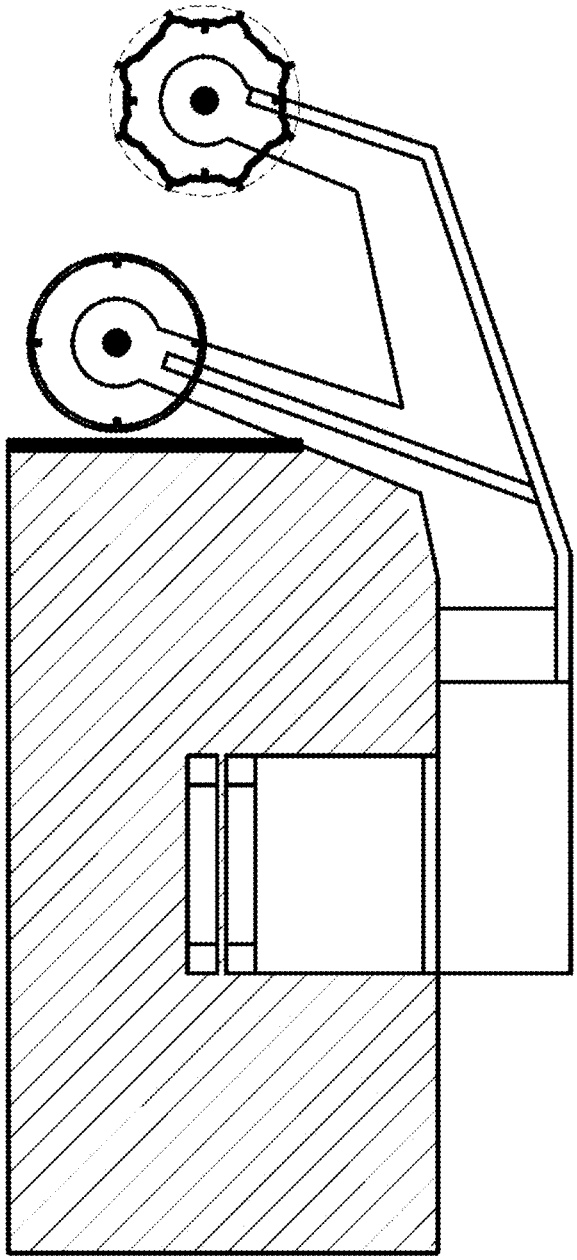

[FIG. 16C]
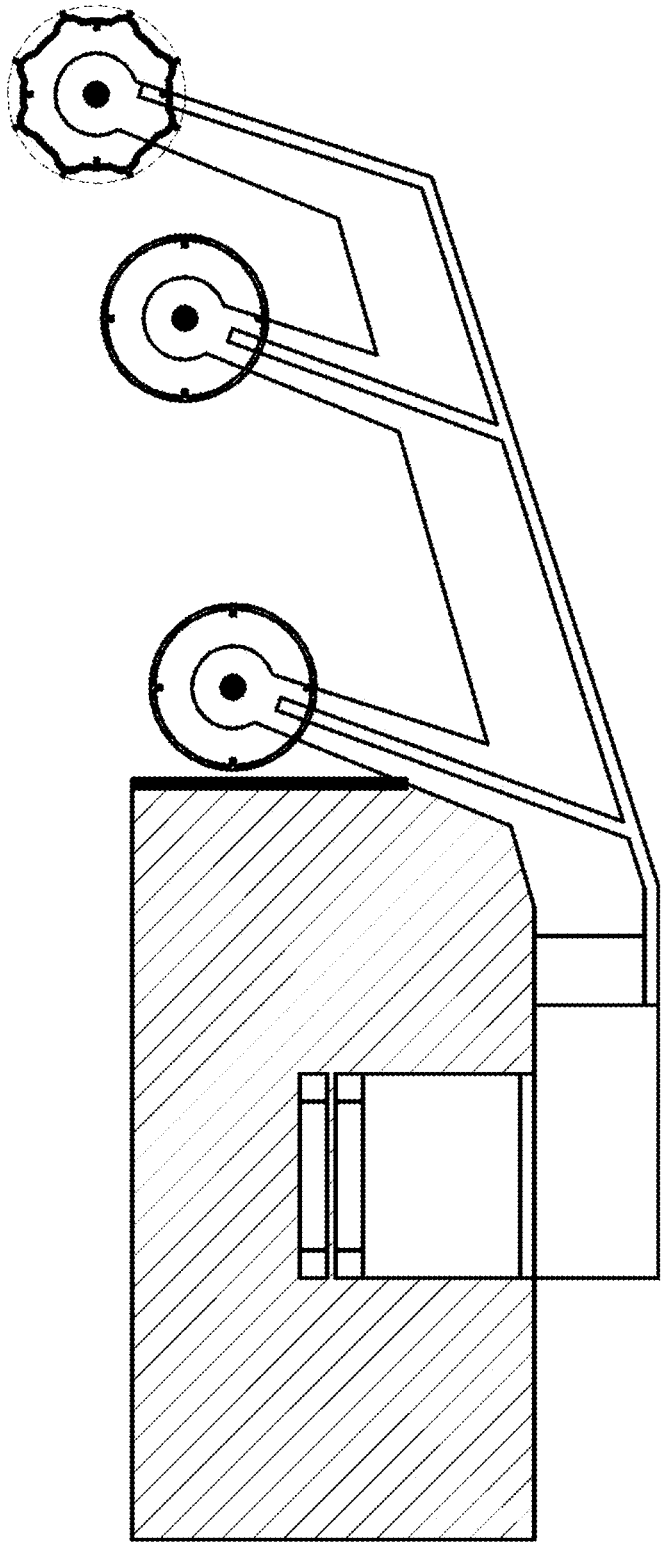

[FIG. 16D]
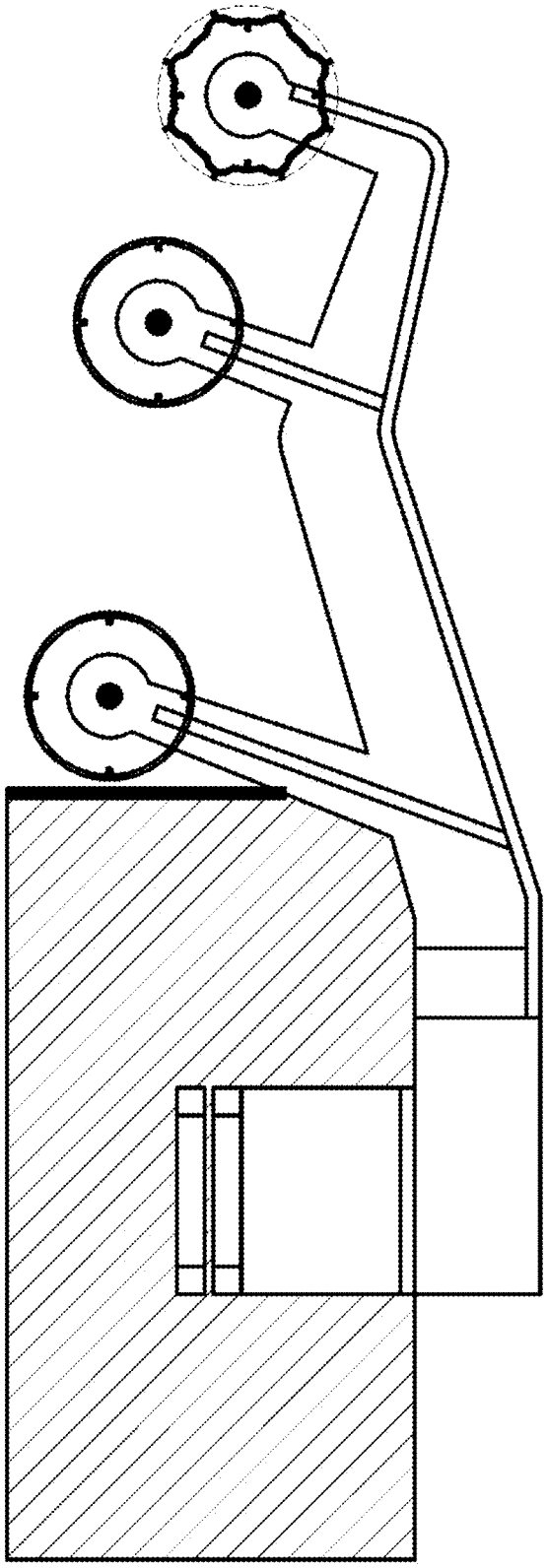

[FIG. 16E]
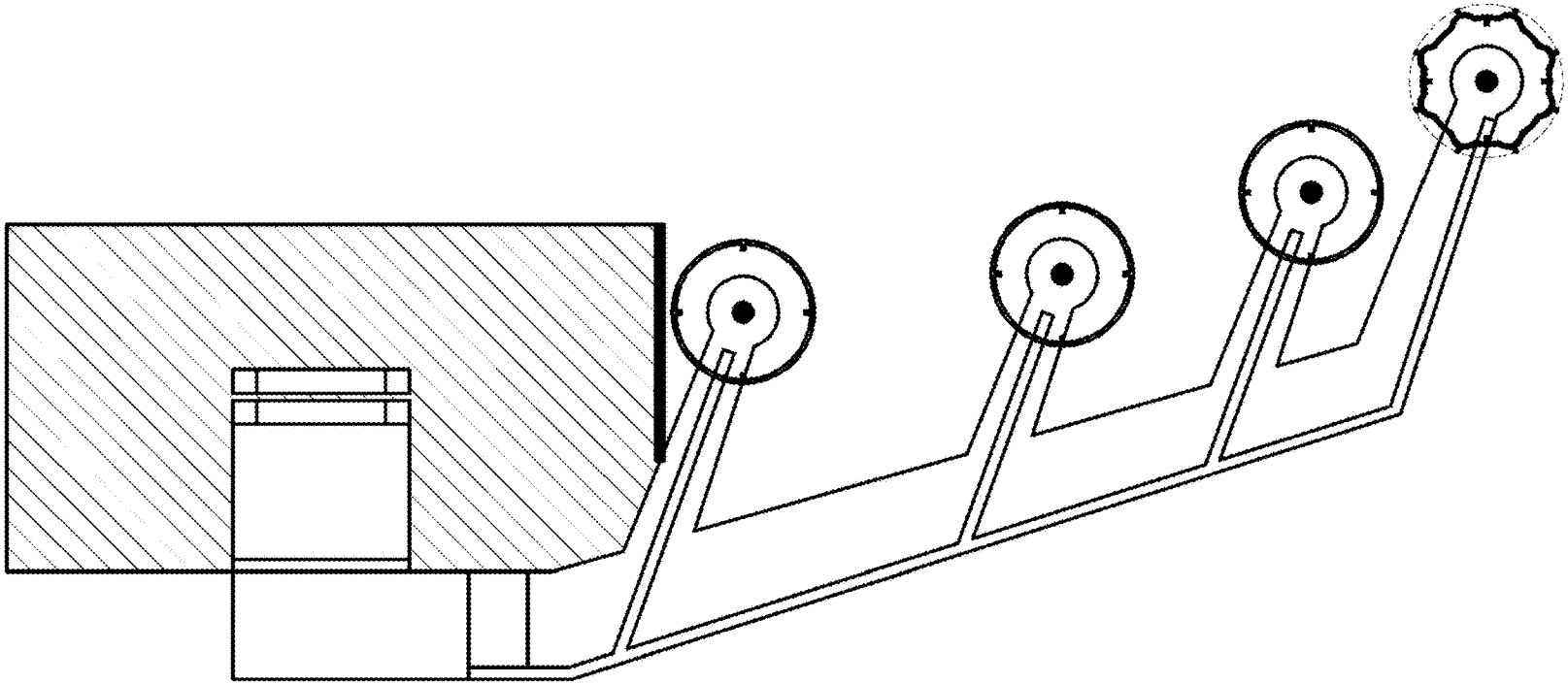

[FIG. 16F]
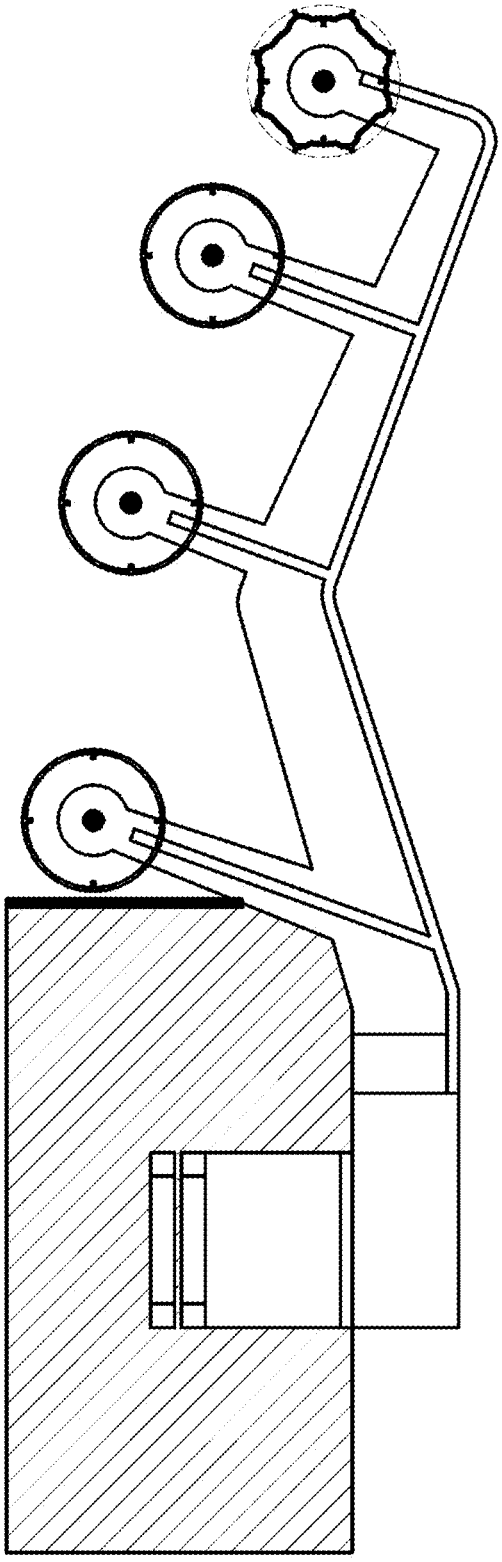

STRUCTURAL PERFORMANCE-IMPROVED SAFETY APPARATUS FOR PREVENTING FALLING AND SUICIDE BY JUMPING

TECHNICAL FIELD

The present invention relates to a safety apparatus with improved structural performance to prevent falling and suicide by jumping, and more particularly, to a safety apparatus with improved structural performance to prevent falling and suicide by jumping that is easily attached to and installed on an existing structure or a novel structure to prevent falling and suicide by jumping.

BACKGROUND ART

In recent years, rates of falling and committing suicide by jumping from bridges or the like have increased significantly. As facilities to prevent such falls and suicide by jumping, railings are installed at edges of bridges or the like.

However, since the existing bridge railings are low in height and can be relatively easily climbed over by people, it is difficult to prevent people attempting suicide by jumping from climbing over the fence.

As one example of the related art to complement the problem of the fence, Korean Patent Registration No. 10-2288906 discloses "Cylindrical rotator system for enhancing security and preventing climbing over fence, falling, and suicide by jumping" (see FIGS. 1A and 1B). The related art provides a cylindrical rotator system for enhancing security and preventing climbing over a fence, falling, and suicide by jumping, the cylindrical rotator system including support parts (110, 110'); and rotary parts (120) rotatably installed on the support parts and configured to, when gripped by a person attempting suicide by jumping, rotate and restrain the person from jumping, wherein the rotary parts each include a pipe (121), a housing (122) installed inside the pipe, a bearing (123) installed on the housing and rotatably provided, a housing cap (124) configured to support one side surface of the bearing to prevent the bearing from deviating from the housing, and fastening members (125, 125') having one end portion installed on the support parts and the other end portion installed on the bearing, the fastening members include a first portion (125*a*) coupled to the bearing, a second portion (125*b*) formed to extend from the first portion, and third portions (125*c*, 125*c'*) formed to extend from the second portion and provided to have a diameter larger than a diameter of the second portion, the support parts include a main body portion (112), an insertion portion (113) that is formed to extend from an end portion of the main body portion, has one open side surface, and has a first insertion space formed therein which is a space into which one portion of the second portion and the third portions are inserted, and a support cap (114) that is configured to finish the one open side surface of the insertion portion and has a second insertion space formed therein which is a space into which the one portion of the second portion and the third portions are inserted, the first insertion space and the second insertion space are formed to have a shape that corresponds to the one portion of the second portion and the third portions, and in a state in which the one portion of the second portion and the third portions are inserted into the first insertion space, the support cap fixes the one portion of the second portion and the third portions by pressing the one open side surface of the insertion portion in a direction perpendicular to rotating shafts of the rotary parts (refer to claim 1 of the related art).

The related art has a problem that portions fixing the support parts (110, 110') to an existing railing may move downward over time, noise may be generated due to vibration of vehicles, or an existing railing may be damaged when fixing the support parts (110, 110') thereto.

In addition, since the insertion portion (113) of the support parts (110, 110') is integrally formed with the main body portion, there are problems that, when it is desired to install fastening members (125, 125') having different specifications, the support parts themselves have to be replaced, when a fastening member coupled to the rotary part is fixed to the insertion portion, a worker needs to fasten the fastening member while holding a heavy rotary member, which makes the assembly task difficult, and when the insertion portion to which the fastening member is fastened is damaged, the support parts also need to be replaced, which leads to an increase in construction costs.

In addition, since spacing between the rotary parts (120) is wide, there are problems that it is difficult to prevent a person attempting suicide by jumping from passing between rotary members while holding the support parts, and in order to prevent this, separate polycarbonate portions should be installed or separate protrusions should be formed on the support parts, which requires additional costs.

Further, since there is no finishing cap at an end portion of the pipe (121), there is a problem that ordinary passersby may get injured when they touch the end portion of the pipe (121) by hand.

DISCLOSURE

Technical Problem

The present invention has been devised to address the above problems and is directed to providing a safety apparatus with improved structural performance to prevent falling and suicide by jumping in which, since a cross-section of a support main body gradually decreases upward and a rib is provided, materials can be saved and even heavy loads can be reliably withstood.

The present invention is also directed to providing a safety apparatus with improved structural performance to prevent falling and suicide by jumping in which, since spacing between an uppermost rotary rail and a rotary rail directly below the uppermost rotary rail, spacing between a lowermost rotary rail and an upper surface of an existing or newly installed railing that is below the lowermost rotary rail, spacing between rotary rails from a second highest rotary rail to the lowermost rotary rail, and the like are chosen optimally, people attempting suicide by jumping are not able to hold a support main body or a branch part, nor are they able to climb over or pass between rotary members, and thus suicide attempts by jumping can be prevented.

The present invention is also directed to providing a safety apparatus with improved structural performance to prevent falling and suicide by jumping in which since a rail coupling structure is improved, a finishing cap housing entirely covers an end portion of a rotary rail and prevents passersby from getting injured, a structure coupling a rotary rail to a rotating shaft is simplified, thus not only making it easy to manufacture but also reducing costs, a bearing installation structure is improved, thus not only allowing a bearing to be quickly and easily installed but also preventing outside rainwater from entering the bearing, heavy loads acting on rotary rails can be reliably withstood, and the rotary rails can be installed even when, as in the case of a curved bridge, an installation direction of the rotary rails gradually changes.

Technical Solution

One embodiment of the present invention provides a safety apparatus with improved structural performance to prevent falling and suicide by jumping that is coupled to an existing or newly installed railing to prevent falling and suicide by jumping, the safety apparatus including support main bodies coupled to railing posts of the existing or newly installed railing; branch parts extending forward from the support main bodies while vertically spaced apart from each other; and rotary rails rotatably coupled to front end portions of the branch parts by rotating shafts, wherein falling and suicide by jumping are able to be prevented due to rotation of the rotary rails.

The safety apparatus may include a post coupling structure coupling the support main body to the railing post, the post coupling structure may include a base plate provided at a lower portion of the support main body and configured to surround the railing post from a back and a base plate cover coupled to a front of the base plate, and the support main body may be firmly coupled to the railing post by inserting the railing post between the base plate and the base plate cover and then coupling the base plate and the base plate cover to each other.

The post coupling structure may include a rubber gasket provided at an inner side of the base plate and/or the base plate cover to not only prevent damage to the railing post but also prevent the support main body from sliding from the railing post.

The coupling of the base plate and the base plate cover to each other may be performed by fastening the base plate and the base plate cover using a fastening member including a loosening preventing washer to prevent loosening.

The support main body may have a cross-section that gradually decreases upward to save materials.

The support main body may include a web that has a wide front-rear width and ribs that protrude from a rear end portion of the web toward both sides.

The branch part may include a branch web that is coplanar with the web of the support main body and branch ribs that protrude toward both left and right sides of the branch web.

The safety apparatus may include a shaft coupling structure coupling the rotating shaft to the front end portion of the branch part, the shaft coupling structure may include a branch coupling surface that is provided at the front end portion of the branch part and has an expanded flat shape, a shaft fastening portion coupled to the branch coupling surface, and a fastening portion finishing cap coupled to a front of the shaft fastening portion, and the rotating shaft may be fitted and coupled between the shaft fastening portion and the fastening portion finishing cap.

The shaft fastening portion may include a shaft coupling surface that has a flat shape corresponding to the branch coupling surface and is coupled to the branch coupling surface, and a shaft insertion portion that is formed at a front of the shaft coupling surface, has an open front, includes an arc surface therein on which a back surface of the rotating shaft is seated, extends forward past a cross-section of the rotating shaft, and into and on which the rotating shaft is inserted and seated.

The fastening portion finishing cap may include a finishing cap configured to cover a front of the shaft insertion portion, and a close contact portion that is formed at a rear of the finishing cap, is tightly inserted into the shaft insertion portion, and includes an arc surface coming into close contact with a front surface of the rotating shaft.

Spacing between an uppermost rotary rail among the rotary rails and a rotary rail directly below the uppermost rotary rail may be set to be 50 mm or less so that a person attempting suicide by jumping is not able to hold the support main body or the branch part through the spacing between the uppermost rotary rail and the rotary rail directly below the uppermost rotary rail and thus not able to easily attempt suicide by jumping.

Spacing between a lowermost rotary rail among the rotary rails and an upper surface of the existing or newly installed railing that is below the lowermost rotary rail may be set to be 10 mm or less so that a person attempting suicide by jumping is not able to place his or her foot between the lowermost rotary rail and the upper surface of the existing or newly installed railing that is below the lowermost rotary rail and thus not able to easily attempt suicide by jumping.

Spacing between rotary rails from a second highest rotary rail among the rotary rails to the lowermost rotary rail may be set to be 150 mm or less so that a person attempting suicide by jumping is not able to pass between the rotary rails and thus not able to easily attempt suicide by jumping.

The uppermost rotary rail among the rotary rails may have a shape in which protruding portions protruding outward and recessed portions recessed inward are repeatedly formed in a circumferential direction.

The protruding portions and the recessed portions may all be formed in a curved shape that is convex outward, an outer rib protruding outward may be provided at an outer center of the protruding portion, and an inner rib protruding inward may be provided at an inner center of the recessed portion.

The safety apparatus may include a rail coupling structure rotatably coupling the rotary rail to the rotating shaft, the rail coupling structure may include a finishing cap housing configured to cover an end portion of the rotary rail, and a bearing installed at a center of the finishing cap housing, and the rotating shaft may be inserted into a center of the bearing and rotate.

The finishing cap housing may include an outer ring coming into close contact with a circumference of an end portion of the rotary rail, an inner ring provided at a central side of the outer ring, a connection ring formed to be recessed to be concave inward in a funnel shape from the outer ring to the inner ring, a bearing housing having a pipe shape formed inside a connecting portion of the connection ring and the inner ring, and a bearing cover coupled to an inner side of the bearing housing, wherein the bearing may be installed by being inserted between the inner ring, the bearing housing, and the bearing cover.

The finishing cap housing may include finishing cap housing reinforcing ribs protruding inward while connecting the outer ring, the connection ring, and the inner side of the bearing housing.

The finishing cap housing may further include a rainwater inflow blocking ring having a pipe shape formed outside the connecting portion of the connection ring and the inner ring.

An edge may be further formed at a circumference of an end portion of the rainwater inflow blocking ring.

Advantageous Effects

According to the present invention, since a cross-section of a support main body gradually decreases upward and a rib is provided, materials can be saved and even heavy loads can be reliably withstood.

In addition, since spacing between an uppermost rotary rail and a rotary rail directly below the uppermost rotary rail, spacing between a lowermost rotary rail and an upper surface of an existing or newly installed railing that is below the lowermost rotary rail, spacing between rotary rails from a second highest rotary rail to the lowermost rotary rail, and the like are chosen optimally, people attempting suicide by jumping are not able to hold a support main body or a branch part, nor are they able to climb over or pass between rotary members, and thus suicide attempts by jumping can be prevented.

Further, since a rail coupling structure is improved, a finishing cap housing entirely covers an end portion of a rotary rail and prevents passersby from getting injured, a structure coupling a rotary rail to a rotating shaft is simplified, thus not only making it easy to manufacture but also reducing costs, a bearing installation structure is improved, thus not only allowing a bearing to be quickly and easily installed but also preventing outside rainwater from entering the bearing, heavy loads acting on rotary rails can be reliably withstood, and the rotary rails can be installed even when, as in the case of a curved bridge, an installation direction of the rotary rails gradually changes.

DESCRIPTION OF DRAWINGS

FIGS. 1A and 1B are views illustrating the related art.

FIG. 2 is a view illustrating an installation state of a safety apparatus with improved structural performance to prevent falling and suicide by jumping according to one embodiment of the present invention.

FIG. 3 is a perspective view of the safety apparatus with improved structural performance to prevent falling and suicide by jumping according to one embodiment of the present invention.

FIG. 4 is a view illustrating a coupling state of a post coupling structure of the safety apparatus with improved structural performance to prevent falling and suicide by jumping according to one embodiment of the present invention.

FIG. 5 is a perspective view of a support main body and a branch part of the safety apparatus with improved structural performance to prevent falling and suicide by jumping according to one embodiment of the present invention.

FIG. 6 is a perspective view of a shaft coupling structure of the safety apparatus with improved structural performance to prevent falling and suicide by jumping according to one embodiment of the present invention.

FIG. 7 is an exploded perspective view of the shaft coupling structure of the safety apparatus with improved structural performance to prevent falling and suicide by jumping according to one embodiment of the present invention.

FIG. 8 is a perspective view of a rotating shaft of the safety apparatus with improved structural performance to prevent falling and suicide by jumping according to one embodiment of the present invention.

FIG. 9 is a perspective view illustrating a state in which the rotating shaft is coupled to the shaft coupling structure of the safety apparatus with improved structural performance to prevent falling and suicide by jumping according to one embodiment of the present invention.

FIG. 10 is a cross-sectional view of an uppermost rotary rail of the safety apparatus with improved structural performance to prevent falling and suicide by jumping according to one embodiment of the present invention.

FIG. 11 is a view illustrating an outer side surface of a finishing cap housing of a rail coupling structure of the safety apparatus with improved structural performance to prevent falling and suicide by jumping according to one embodiment of the present invention.

FIG. 12 is a view illustrating an inner side surface of the finishing cap housing of the rail coupling structure of the safety apparatus with improved structural performance to prevent falling and suicide by jumping according to one embodiment of the present invention.

FIG. 13 is a view illustrating a bearing installed on the finishing cap housing of the rail coupling structure of the safety apparatus with improved structural performance to prevent falling and suicide by jumping according to one embodiment of the present invention.

FIG. 14 is a view illustrating a state in which a bearing cover is installed on the finishing cap housing of the rail coupling structure of the safety apparatus with improved structural performance to prevent falling and suicide by jumping according to one embodiment of the present invention.

FIG. 15 is a view illustrating a state in which rotary rails are coupled by the rail coupling structure of the safety apparatus with improved structural performance to prevent falling and suicide by jumping according to one embodiment of the present invention.

FIGS. 16A to 16F are views illustrating various embodiments of the safety apparatus with improved structural performance to prevent falling and suicide by jumping according to one embodiment of the present invention.

[Description of reference numerals]

| | | | |
|---|---|---|---|
| 2: | railing post | 10: | support main body |
| 12: | branch part | 22: | base plate |
| 24: | base plate cover | 26: | rubber gasket |
| 30: | rotary rail | 32: | protruding portion |
| 322: | outer rib | 34: | recessed portion |
| 342: | inner rib | 42: | branch coupling surface |
| 442: | shaft coupling surface | 444: | shaft insertion portion |
| 462: | finishing cap | 464: | close contact portion |
| 50: | rotating shaft | 622: | outer ring |
| 623: | inner ring | 624: | connection ring |
| 626: | bearing housing | 627: | bearing cover |
| 628: | finishing cap housing reinforcing rib | | |
| 629: | rainwater inflow blocking ring | | |
| 64: | bearing | | |

MODES OF THE INVENTION

Hereinafter, some embodiments of the present invention will be described in detail through exemplary drawings. In assigning reference numerals to components of each drawing, it should be noted that the same reference numerals are assigned to the same components wherever possible even when the components are illustrated in different drawings. Also, in describing the embodiments of the present invention, when it is determined that the detailed description of a known related configuration or function may hinder understanding of the embodiments of the present invention, the detailed description thereof will be omitted.

In addition, in describing components of the embodiments of the present invention, terms such as "first," "second," "A," "B," "(a)," and "(b)" may be used. Such terms are only for distinguishing one component from another component, and the essence, order, sequence, or the like of the corresponding component is not limited by the terms. In a case in which a certain component is described as being "connected," "coupled," or "linked" to another component, although the component may be directly connected or linked to the other component, still another component may also be "connected," "coupled," or "linked" between the two components.

Hereinafter, a safety apparatus with improved structural performance to prevent falling and suicide by jumping according to one embodiment of the present invention will be described with reference to the drawings.

FIG. 2 is a view illustrating an installation state of a safety apparatus with improved structural performance to prevent falling and suicide by jumping according to one embodiment of the present invention, FIG. 3 is a perspective view of the safety apparatus with improved structural performance to prevent falling and suicide by jumping according to one embodiment of the present invention, FIG. 4 is a view illustrating a coupling state of a post coupling structure of the safety apparatus with improved structural performance to prevent falling and suicide by jumping according to one embodiment of the present invention, FIG. 5 is a perspective view of a support main body and a branch part of the safety apparatus with improved structural performance to prevent falling and suicide by jumping according to one embodiment of the present invention, FIG. 6 is a perspective view of a shaft coupling structure of the safety apparatus with improved structural performance to prevent falling and suicide by jumping according to one embodiment of the present invention, FIG. 7 is an exploded perspective view of the shaft coupling structure of the safety apparatus with improved structural performance to prevent falling and suicide by jumping according to one embodiment of the present invention, FIG. 8 is a perspective view of a rotating shaft of the safety apparatus with improved structural performance to prevent falling and suicide by jumping according to one embodiment of the present invention, FIG. 9 is a perspective view illustrating a state in which the rotating shaft is coupled to the shaft coupling structure of the safety apparatus with improved structural performance to prevent falling and suicide by jumping according to one embodiment of the present invention, FIG. 10 is a cross-sectional view of an uppermost rotary rail of the safety apparatus with improved structural performance to prevent falling and suicide by jumping according to one embodiment of the present invention, FIG. 11 is a view illustrating an outer side surface of a finishing cap housing of a rail coupling structure of the safety apparatus with improved structural performance to prevent falling and suicide by jumping according to one embodiment of the present invention, FIG. 12 is a view illustrating an inner side surface of the finishing cap housing of the rail coupling structure of the safety apparatus with improved structural performance to prevent falling and suicide by jumping according to one embodiment of the present invention, FIG. 13 is a view illustrating a bearing installed on the finishing cap housing of the rail coupling structure of the safety apparatus with improved structural performance to prevent falling and suicide by jumping according to one embodiment of the present invention, FIG. 14 is a view illustrating a state in which a bearing cover is installed on the finishing cap housing of the rail coupling structure of the safety apparatus with improved structural performance to prevent falling and suicide by jumping according to one embodiment of the present invention, FIG. 15 is a view illustrating a state in which rotary rails are coupled by the rail coupling structure of the safety apparatus with improved structural performance to prevent falling and suicide by jumping according to one embodiment of the present invention, and FIGS. 16A to 16F are views illustrating various embodiments of the safety apparatus with improved structural performance to prevent falling and suicide by jumping according to one embodiment of the present invention.

One embodiment of the present invention provides a safety apparatus with improved structural performance to prevent falling and suicide by jumping that is coupled to an existing or newly installed railing to prevent falling and suicide by jumping, the safety apparatus including support main bodies 10 coupled to railing posts 2 of the existing or newly installed railing; branch parts 12 extending forward from the support main bodies 10 while vertically spaced apart from each other; and rotary rails 30 rotatably coupled to front end portions of the branch parts 12 by rotating shafts 50, wherein falling and suicide by jumping are able to be prevented due to rotation of the rotary rails 30.

The support main bodies 10 may be coupled to railing posts 2 of an existing railing that is in use after being constructed or may be coupled to railing posts 2 of a newly installed railing that is constructed together with a safety railing. The support main bodies 10 may be coupled to every railing post 2 or may be coupled to every other or every third railing post 2. The support main bodies 10 may be formed in various ways to correspond to on-site situations, e.g., formed upright in a vertical direction, inclined forward at a certain angle, gradually bent forward toward an upper side, inclined rearward at a certain angle, gradually bent rearward toward an upper side, or bent forward or rearward from a middle. In the present embodiment, "forward," "front," and the like refer to a direction toward a roadway from a bridge, and "rearward," "back," and the like refer to a direction away from the roadway.

The branch parts 12 may be formed at a front of the support main bodies 10 to extend forward therefrom. Two or more branch parts 12 may be formed. The branch parts 12 may have a length that gradually increases upward, gradually decreases upward, increases and then decreases, or decreases and then increases.

The height and bent shape of the support main bodies 10, the number and length of the branch parts 12, and the like may vary as illustrated in FIGS. 16A to 16F.

The rotary rails 30 are installed between adjacent branch parts 12 and may be rotatably coupled to a rotating shaft 50 coupled to an end portion of the branch part 12. That is, the rotating shaft 50 may be coupled to an end portion of the branch part 12, and the rotary rail 30 may be rotatably coupled to the rotating shaft 50. Accordingly, when a person attempting suicide by jumping holds the rotary rail 30, since the rotary rail 30 rotates, it may not be easy to climb over a safety railing and attempt suicide by jumping.

A post coupling structure coupling the support main bodies 10 to the railing posts 2 may include a base plate 22 provided at lower portions of the support main bodies 10 and configured to surround the railing posts 2 from a back and a base plate cover 24 coupled to a front of the base plate 22.

The base plate 22 may be welded and coupled to the lower portion of the support main body 10 or may be integrally formed with the support main body 10. The base plate 22 corresponds to the shape of the railing post 2. That is, when the railing post 2 has a quadrangular shape, the base plate 22 may be formed in an angular C-shape that surrounds the back of the railing post 2. In this case, the base plate cover 24 may have a flat plate shape or have an angular c-shape that surrounds the railing post 2 from a front. Also, when the railing post 2 has a circular shape, the base plate 22 may be formed in a semi-arc shape that surrounds the back of the railing post 2. In this case, the base plate cover 24 may also have a semi-arc shape that surrounds the front thereof.

The support main body 10 may be firmly coupled to the railing post 2 by inserting the railing post 2 between the base plate 22 and the base plate cover 24 and then coupling the base plate 22 and the base plate cover 24 to each other using a fastening member such as a bolt.

The post coupling structure may include a rubber gasket 26 provided at an inner side of the base plate 22 and/or the base plate cover 24. The rubber gasket 26 may be inserted as a separate member, coated on an inner side of the base plate 22 or the base plate cover 24, or attached using an adhesive or the like.

The rubber gasket 26 may not only prevent damage to the railing post 2 when the support main body 10 is coupled thereto but also prevent the support main body 10 from sliding from the railing post 2. Also, the rubber gasket 26 may prevent noise that may be generated due to vibration of vehicles passing by.

A bolt, which is a fastening member coupling the base plate 22 and the base plate cover 24 to each other, may include a loosening preventing washer to prevent loosening. In the case of a bridge or the like, since vibration due to vehicles is continuously generated, the loosening preventing washer may be effective in preventing loosening of the bolt caused by the vibration due to vehicles.

The support main body 10 may have a cross-section that gradually decreases upward to save materials. That is, materials may be efficiently used by decreasing the cross-section at an upper side on which bending moment or the like does not act much and increasing the cross-section at a lower side on which bending moment or the like acts much. The cross-section may decrease at a constant ratio from the lower side to the upper side or may gradually decrease only above a predetermined point on the upper side.

The support main body 10 may include a web that has a wide front-rear width and ribs that protrude from a rear end portion of the web toward both sides. That is, the support main body 10 may be formed in a T-shape. The cross-section may decrease only at the web or the ribs or may simultaneously decrease at the web and the ribs.

The branch parts 12 may each include a branch web that is coplanar with the web of the support main body 10 and branch ribs that protrude toward both left and right sides of the branch web. The branch parts 12 may each be formed in a T-shape or a cross shape. The branch parts 12 may have a cross-section that gradually decreases toward a front end portion.

Torsional resistance may significantly increase in the support main body 10 and the branch part 12 including webs and ribs.

The safety apparatus may include a shaft coupling structure coupling the rotating shaft 50 to the front end portion of the branch part 12. The rotating shaft 50 may be coupled to an end portion of the branch part 12 using a fastening member such as a bolt and may be inserted into the rotary rail 30 for the rotary rail 30 to be rotatably coupled thereto. Since the rotating shaft 50 is coupled using the fastening member such as a bolt, a separate shape for preventing deviation is unnecessary, and thus machining of the rotating shaft 50 may be easy.

The shaft coupling structure may include a branch coupling surface 42 that is provided at the front end portion of the branch part 12 and has an expanded flat shape, a shaft fastening portion 44 coupled to the branch coupling surface 42, and a fastening portion finishing cap 46 coupled to a front of the shaft fastening portion 44, and the rotating shaft 50 may be fitted and coupled between the shaft fastening portion 44 and the fastening portion finishing cap 46.

The branch coupling surface 42 is a flat surface expanding from an end portion of the branch part 12 and may have a hole formed therein to allow the fastening member such as a bolt to be inserted and fastened. The hole may be one or more holes formed at upper and lower portions in consideration of applied loads. Also, the hole formed in the branch coupling surface 42 may be formed to be long in the left-right direction to enable slight adjustment of the fastening member such as a bolt.

The shaft fastening portion 44 may include a shaft coupling surface 442 that has a flat shape corresponding to the branch coupling surface 42 and is coupled to the branch coupling surface 42, and a shaft insertion portion 444 that is formed at a front of the shaft coupling surface 442, has an open front, includes an arc surface therein on which a back surface of the rotating shaft 50 is seated, extends forward past a cross-section of the rotating shaft 50, and into and on which the rotating shaft 50 is inserted and seated.

That is, the shaft coupling surface 442 may be formed with the same size as the branch coupling surface 42. A hole allowing the fastening member such as a bolt to be inserted and fastened may be formed in the shaft coupling surface 442 at the same position as in the branch coupling surface 42.

A fitting recessed portion and a fitting protruding portion that may be fitted to each other may be formed on surfaces of the shaft coupling surface 442 and the branch coupling surface 42 that face each other. The fitting recessed portion and the fitting protruding portion may facilitate placing the shaft coupling surface 442 at an accurate position relative to the branch coupling surface 42 to facilitate the fastening task, and also prevent the shaft coupling surface 442 and the branch coupling surface 42 from sliding from each other, thereby increasing a coupling force.

The shaft insertion portion 444 may be formed to protrude at the front of the shaft coupling surface 442 and may have an open front. An arc surface, e.g., a semi-arc surface, on which a back surface of the rotating shaft 50 is seated may be included inside the open front to allow the rotating shaft 50 to be inserted and seated. The shaft insertion portion 444 extends forward past the cross-section of the rotating shaft 50 to prevent the rotating shaft 50, to which the rotary rail 30 is coupled, from being detached by itself after being installed, and thus a worker can easily proceed to a subsequent task without supporting the rotary rail 30.

The fastening portion finishing cap 46 may include a finishing cap 462 configured to cover a front of the shaft insertion portion 444, and a close contact portion 464 that is formed at a rear of the finishing cap 462, is tightly inserted into the shaft insertion portion 444, that is, the portion into which the rotating shaft 50 is inserted, and includes an arc surface coming into close contact with a front surface of the rotating shaft 50. The fastening portion finishing cap 46 may firmly fix the rotating shaft 50 by the finishing cap 462 coming into contact with a front surface of the shaft insertion portion 444 and the close contact portion 464 being tightly inserted into the shaft insertion portion 444 and coming into close contact with the front surface of the rotating shaft 50. Then, the fastening member such as a bolt may be coupled to the shaft fastening portion 44 by passing through the finishing cap 462 and the close contact portion 464 of the fastening portion finishing cap 46 and the rotating shaft 50.

Spacing between an uppermost rotary rail 30 among the rotary rails 30 and a rotary rail 30 directly below the uppermost rotary rail 30 may be set to be 50 mm or less so that a person attempting suicide by jumping is not able to hold the support main body 10 or the branch part 12 through the spacing between the uppermost rotary rail 30 and the rotary rail 30 directly below the uppermost rotary rail 30 and thus not able to easily attempt suicide by jumping. In a situation in which the rotary rails 30 rotate, a person attempting suicide by jumping tends to hold the support main body 10 or the branch part 12 located at an upper side to climb over a safety railing, and according to the present embodiment, since the person is not able to hold the support main body 10 or the branch part 12 located at the upper side, it may become difficult to attempt suicide by jumping.

In addition, spacing between a lowermost rotary rail 30 among the rotary rails 30 and an upper surface of the existing or newly installed railing that is below the lowermost rotary rail 30 may be set to be 10 mm or less so that a person attempting suicide by jumping is not able to place his or her foot between the lowermost rotary rail 30 and the upper surface of the existing or newly installed railing that is below the lowermost rotary rail 30 and thus not able to easily attempt suicide by jumping. In order to climb over a safety railing, a person attempting suicide by jumping needs to place his or her foot somewhere on a lower portion while holding an upper portion by hand. According to the present embodiment, since a space on which a foot may be placed is excluded, attempts to commit suicide by jumping can be effectively prevented.

In addition, spacing between rotary rails 30 from a second highest rotary rail 30 among the rotary rails 30 to the lowermost rotary rail 30 may be set to be 150 mm or less so that, even when a person attempting suicide by jumping is a child, the person is not able to pass between the rotary rails 30 and thus not able to easily attempt suicide by jumping.

The uppermost rotary rail 30 among the rotary rails 30 may have a shape in which protruding portions 32 protruding outward and recessed portions 34 recessed inward are repeatedly formed in a circumferential direction. Due to the protruding portions 32 and the recessed portions 34 being repeatedly formed, the stiffness of the uppermost rotary rail 30 that a person attempting suicide by jumping tends to hold may be increased. The protruding portions 32 and the recessed portions 34 may all be formed in a curved shape that is convex outward. That is, the protruding portion 32 may have a shape that protrudes outward while being convex outward, and the recessed portion 34 may have a shape that is recessed inward while being convex outward. For example, the protruding portion 32 may have a shape that protrudes outward while having a small radius of curvature, and the recessed portion 34 may have a shape that is recessed inward while having a large radius of curvature. All of the protruding portions 32 and the recessed portions 34 being convex outward may be very effective in withstanding a bending force, a crushing force, a torsional force or the like caused by an external force.

An outer rib 322 protruding outward may be provided at an outer center of the protruding portion 32 in a longitudinal direction of the rotary rail 30, and an inner rib 342 protruding inward may be provided at an inner center of the recessed portion 34 in the longitudinal direction of the rotary rail 30. The outer rib 322 and the inner rib 342 may increase the stiffness of the rotary rail 30. That is, according to the present embodiment, due to the protruding portions 32 and the recessed portions 34 that are convex outward, the outer rib 322, and the inner rib 342, the stiffness against bending, crushing, or the like may be significantly increased as compared to other rotary rails 30 made of the same material. In addition, the outer rib 322 may make it difficult for a person attempting suicide by jumping to hold the rotary rail 30 and thus make it difficult to attempt suicide by jumping.

A rail coupling structure rotatably coupling the rotary rail 30 to the rotating shaft 50 may include a finishing cap housing configured to cover an end portion of the rotary rail 30, and a bearing 64 installed at a center of the finishing cap housing, and the rotating shaft 50 may be inserted into a center of the bearing 64 and rotate.

The finishing cap housing may include an outer ring 622 coming into close contact with a circumference of an end portion of the rotary rail 30, an inner ring 623 provided at a central side of the outer ring 622, a connection ring 624 formed to be recessed to be concave inward in a funnel shape from the outer ring 622 to the inner ring 623, a bearing housing 626 having a pipe shape formed inside a connecting portion of the connection ring 624 and the inner ring 623, and a bearing cover 627 coupled to an inner side of the bearing housing 626 using a fastening member such as a bolt. The bearing 64 may be installed by being inserted between the inner ring 623, the bearing housing 626, and the bearing cover 627.

By entirely covering an end portion of the rotary rail 30, the finishing cap housing prevents rainwater or the like from entering the rotary rail 30 and prevents passersby from getting injured even when they touch the rotary rail 30 by hand.

The outer ring 622 may come into close contact with an end portion of the rotary rail 30 and may be coupled thereto using a fastening member such as a bolt or by welding or the like. Fitting portions may be formed to protrude from an inner side of the outer ring 622 in the circumferential direction. The fitting portions may be fitted to come into close contact with an inner surface of the rotary rail 30, thereby increasing a structural coupling force between the finishing cap housing and the rotary rail 30 and preventing the end portion of the rotary rail 30 from being crushed. Finishing cap housing reinforcing ribs 628 may also be fitted to come into close contact with an inner surface of the rotary rail 30, thereby increasing a structural coupling force between the finishing cap housing and the rotary rail 30 and preventing the end portion of the rotary rail 30 from being crushed.

The inner ring 623 is located at the center of the outer ring 622 and may prevent the bearing 64 from being deviated outward. A hole into which the rotating shaft 50 is inserted may be formed at the center of the inner ring 623.

The connection ring 624 connects the outer ring 622 and the inner ring 623 and may be formed in a funnel shape that is concave inward. By being formed in the funnel shape that is concave inward, the connection ring 624 may minimize exposure of the bearing 64 to rainwater or the like and minimize exposure of the rotating shaft 50 to effectively prevent a person attempting suicide by jumping from holding the rotating shaft 50 or the branch part 12. Also, the funnel shape may increase structural stability of a connecting portion between the rotary rail 30 and the rotating shaft 50, together with the outer ring 622, the inner ring 623, the bearing housing 626, a rainwater inflow blocking ring 629, and the like.

The bearing housing 626 may have a pipe shape that is formed inside the connecting portion of the connection ring 624 and the inner ring 623. The bearing 64 may be inserted into the bearing housing 626.

The finishing cap housing may include the finishing cap housing reinforcing ribs 628 protruding inward while connecting the outer ring 622, the connection ring 624, and the inner side of the bearing housing 626. The finishing cap housing reinforcing ribs 628 may further increase the stiffness of the finishing cap housing to significantly increase the structural stability of the connecting portion between the rotary rail 30 and the rotating shaft 50.

The bearing cover 627 may be coupled to the inner side of the bearing housing 626 using a fastening member such as a bolt. That is, the bearing cover 627 may be coupled to the bearing housing 626 or the finishing cap housing reinforcing ribs 628 using the fastening member such as a bolt. A hole may be formed at a center of the bearing cover 627.

The finishing cap housing may further include the rainwater inflow blocking ring 629 having a pipe shape formed outside the connecting portion of the connection ring 624 and the inner ring 623. That is, the bearing 64 may be protected well by the rainwater inflow blocking ring 629 causing rainwater, which enters along the outer ring 622 and the connection ring 624, to drop downward from the rainwater inflow blocking ring 629 without entering the bearing 64.

In addition, an edge may be formed to protrude from a circumference of an end portion of the rainwater inflow blocking ring 629. The protruding edge may completely prevent rainwater from entering the bearing 64.

In the above, even if all the components constituting the embodiments of the present invention have been described as being combined or combined to operate as one, the present invention is not necessarily limited to these embodiments. That is, if within the scope of the present invention, all of the components may be selectively combined and operated as one or more. In addition, the terms "include," "consist," or "have" as described above mean that a corresponding component may be intrinsic, unless specifically stated otherwise, and it should be interpreted as including other components rather than excluding other components. All terms including technical or scientific terms have the same meanings as those commonly understood by those skilled in the art to which the present invention pertains, unless defined otherwise. Terms commonly used as those defined in a commonly used dictionary should be construed as being consistent with the context of the relevant art, and are not to be construed in an idealized or overly formal sense unless expressly defined in the present invention.

The above description is merely illustrative of the technical idea of the present invention, and those skilled in the art to which the present invention pertains may make various modifications and variations without departing from the essential characteristics of the present invention. Therefore, the embodiments disclosed in the present invention are not intended to limit the technical spirit of the present invention, but to explain, and the scope of the technical spirit of the present invention is not limited by these embodiments. The scope of protection of the present invention should be construed from the following claims, and all technical concepts within the scope of the present invention should be construed as being included within the scope of the rights of present invention.

The invention claimed is:

1. A safety apparatus with improved structural performance to prevent falling and suicide by jumping that is coupled to an existing or newly installed railing to prevent falling and suicide by jumping, the safety apparatus comprising:

support main bodies coupled to railing posts of the existing or newly installed railing;

branch parts configured to extend forward from the support main bodies while vertically spaced apart from each other; and rotary rails rotatably coupled to front end portions of the branch parts by rotating shafts, wherein falling and suicide by jumping are able to be prevented due to rotation of the rotary rails, the safety apparatus includes a rail coupling structure rotatably coupling the rotary rail to the rotating shaft, the rail coupling structure includes a finishing cap housing configured to cover an end portion of the rotary rail, and a bearing installed at a center of the finishing cap housing, the rotating shaft is inserted into a center of the bearing and rotates, the finishing cap housing includes an outer ring coming into contact with a circumference of an end portion of the rotary rail, an inner ring provided at a central side of the outer ring, a connection ring formed to be recessed to be concave in a funnel shape from the outer ring to the inner ring, a bearing housing having a pipe shape formed inside a connecting portion of the connection ring and the inner ring, and a bearing cover coupled to an inner side of the bearing housing, wherein the bearing is installed by being inserted between the inner ring, the bearing housing, and the bearing cover, the finishing cap housing includes finishing cap housing reinforcing ribs protruding inward while connecting the outer ring, the connection ring, and the inner side of the bearing housing, the finishing cap housing further includes a rainwater inflow blocking ring having a pipe shape formed outside the connecting portion of the connection ring and the inner ring, and by being fitted to come into contact with an inner surface of the rotary rail, the finishing cap housing reinforcing ribs increase a structural coupling force between the finishing cap housing and the rotary rail and prevent the end portion of the rotary rail from being deformed.

2. The safety apparatus of claim 1, wherein the support main body has a cross-section that gradually decreases upward to save materials.

3. The safety apparatus of claim 2, wherein the support main body includes a web that has a wide front-rear width and ribs that protrude from a rear end portion of the web toward both sides.

4. The safety apparatus of claim 1, wherein spacing between an uppermost rotary rail among the rotary rails and a rotary rail directly below the uppermost rotary rail is set to be 50 mm or less so that a person attempting suicide by jumping is not able to hold the support main body or the branch part through the spacing between the uppermost rotary rail and the rotary rail directly below the uppermost rotary rail and thus not able to easily attempt suicide by jumping.

5. The safety apparatus of claim 1, wherein spacing between a lowermost rotary rail among the rotary rails and an upper surface of the existing or newly installed railing that is below the lowermost rotary rail is set to be 10 mm or less so that a person attempting suicide by jumping is not able to place his or her foot between the lowermost rotary rail and the upper surface of the existing or newly installed railing that is below the lowermost rotary rail and thus not able to easily attempt suicide by jumping.

6. The safety apparatus of claim 1, wherein spacing between rotary rails from a second highest rotary rail among the rotary rails to the lowermost rotary rail is set to be 150 mm or less so that a person attempting suicide by jumping is not able to pass between the rotary rails and thus not able to easily attempt suicide by jumping.

* * * * *